United States Patent [19]

Forman

[11] Patent Number: 4,624,579

[45] Date of Patent: Nov. 25, 1986

[54] IN-THE-WALL CLOCK

[76] Inventor: Everett W. Forman, 4107 Eldorado Cove, Bradenton, Fla. 33507

[21] Appl. No.: 790,764

[22] Filed: Oct. 23, 1985

Related U.S. Application Data

[63] Continuation of Ser. No. 746,935, Jun. 20, 1985, abandoned, which is a continuation of Ser. No. 504,610, Jun. 15, 1983, abandoned.

[51] Int. Cl.[4] ..... G04C 23/02; G04B 19/04

[52] U.S. Cl. ..... 368/88; 368/228; 368/278; 368/316

[58] Field of Search ..... 368/76, 80, 88, 220, 368/223, 228, 276–279, 284, 299–300, 316–317

[56] References Cited

U.S. PATENT DOCUMENTS

| | | | |
|---|---|---|---|
| 1,611,568 | 12/1926 | Standow | 368/316 |
| 1,847,800 | 3/1932 | Weil | 368/228 |
| 1,973,871 | 9/1934 | Hoegger | 368/316 |
| 2,044,314 | 6/1936 | Mattman | 368/316 |
| 2,219,354 | 10/1940 | Ciccarelli | 368/316 |
| 2,651,908 | 9/1953 | Fargo | 368/316 |
| 3,807,236 | 4/1974 | Leone | 368/316 |
| 4,112,672 | 9/1978 | Ginefra | 368/277 |

*Primary Examiner*—Vit W. Miska

[57] ABSTRACT

An in-the-wall clock attachable to a preconstructed wall, and partially inserted into a hole in the wall, gives the appearance of having been inserted from the back of the wall prior to construction of the wall. This is effected by means of a ring, preferably a clock time ring, in conjunction with a back plate behind which the clock mechanism is placed. The back plate is surfaced in a similar manner to the wall. The face ring is positioned to mask the edge of the back plate, the combination of time ring and back plate concealing the wall hole. Thus the illusion is created that the clock mechanism was prebuilt in the wall prior to final construction of the wall, and that the time ring was subsequently attached to the intact wall to delineate the clock face, or provide the clock numerals.

1 Claim, 4 Drawing Figures

IN-THE-WALL CLOCK

SUMMARY OF THE INVENTION

This is a continuation of Ser. No. 746,935, 6/20/85 now abandoned, which is a continuation of Ser. No. 504,640, 6/15/83 now abandoned.

1. Field of the Invention

The present invention relates to in-the-wall clocks, and specifically to one in which the mechanism can be inserted into a finished wall, yet appears to have been placed in the wall prior to final construction of the wall.

2. Description of Prior Art

Heretofore in-the-wall clocks, in which only the hands and numerals are visible, required that the mechanism be inserted from the back of the visible surface of the wall. This had to be done prior to final construction of the wall, unless the finished wall was accessible from th back as in a hinged partition, etc. Alternatively the clock mechanism can be inserted from the front of the wall, and a masking disc placed over the wall hole, hiding the mechanism. This latter method, however, quite obviously reveals the post-construction insertion of the clock mechanism in the wall, and the disc is obviously visible, in addition to the hands and numerals.

3. Object of the Invention

The object of the invention is to provide an easy means of simulating, in a constructed wall, a clock preconstructed in the wall, applicable to battery, as well as electrically, operated clocks.

A further object is to provide for easy insertion and removal for repairs, or for battery change should this type of clock be used.

A further object is to make the clock relatively inexpensive.

DETAILED DESCRIPTION OF THE INVENTION

Figure 1:
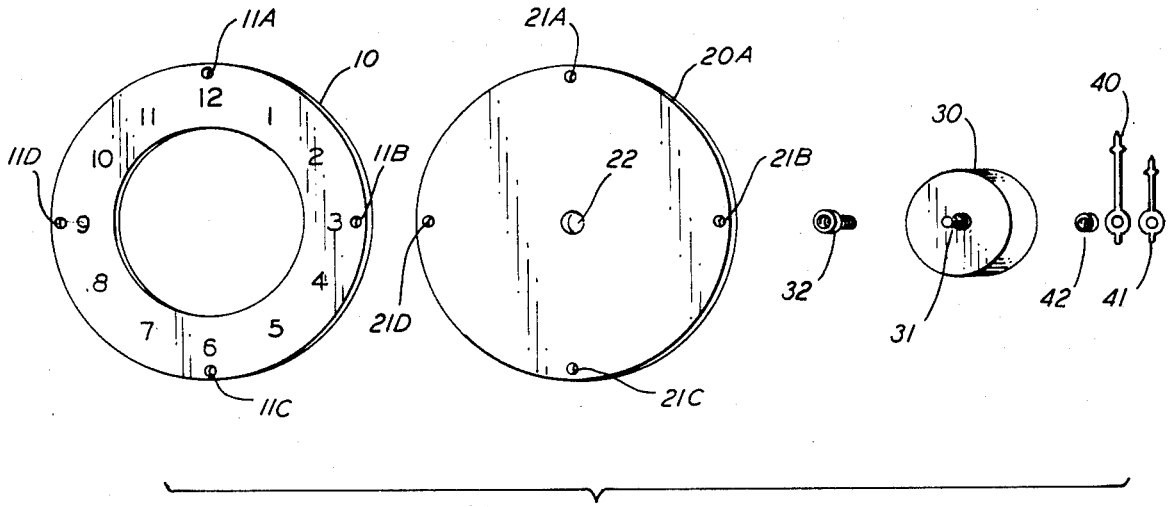
FIG. 1 is a perspective view of the four components of the invention.

In FIG. 1 are shown the four components of the device: a ring, more specifically in the drawings and descriptions hereafter, a clock time ring, also called a "face ring", 10, a back plate, 20A, a clock mechanism, 30, and a set of clock hands, 40 and 41. The time ring, 10, has four screw-hole, 11A, 11B, 11C and 11D. The back plate, 20A, preferably quite thin for esthetic appearance, has a circumference compatible with the outside circumference of the time ring, 10, and screw holes 21A, 21B, 21C and 21D, complementary to the screw-holes 11A, B, C and D, in the time ring, 10. Additionally there is a central hole, 22, in the back plate, 20A. The clock mechanism, 30, has the usual handshaft, 31, and mounting nut, 32. The set of clock hands, 40 and 41, and hand nut, 42, are compatible with the handshaft, 31. The central hole, 22, in the back plate, 20A is of a size to accomodate said handshaft.

Figure 2:
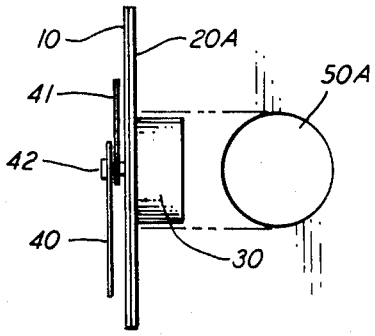
FIG. 2 is a side view of the assembled components, shown in relation to a frontal view of a complementary wall hole.

FIG. 2 shows the four components: time ring, 10, back plate, 20A, clock mechanism, 30, and set of hands, 40 and 41, assembled. The clock mechanism, 30, is attached to the back plate, 20A, by the retaining nut, 32, and the hands, 40 and 41, are attached to the handshaft, 31, by the hand nut, 42. The combined unit is attachable to a wall by means of screws passed through the aligned screw holes, 21A, B, C and D, in the back plate, 20A. The wall hole, 50A, is large enough to accomodate the clock mechanism, 30. While the time ring, 10, and the back plate, 20A, are shown separately, they alternatively can be combined as a single unit, the separate parts, however, provide for easier painting or covering of the visible central portion of the back plate, 20A.

Figure 3:
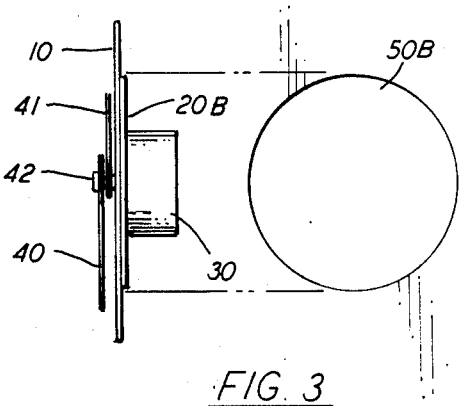
FIG. 3 is a side view of the assembled components of an alternate composition, shown in relation to a frontal view of a complementary wall hole.

FIG. 3 shows the four components assembled, as above, using a smaller back plate, 20B, whose circumference is between the sizes of the inner and outer circumferences of the time ring, 10. The wall hole, 50B, has a circumference larger than that of this back plate, yet smaller than the outside circumference of the time ring.

Figure 4:
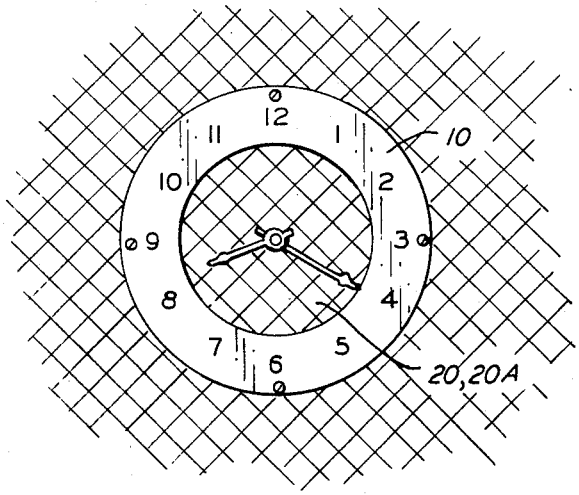
FIG. 4 is a frontal view of the assembled components after attachment to, and partial insertion in, a wall.

FIG. 4 shows the unit, in either variation assembled and attached to a wall as seen from the front.

In use, the visibly exposed central portion of the back plate, 20A, is painted or covered similarly to the wall to which it is to be attached. The four components are assembled as described above, and as shown in FIG. 2, and attached to the wall by means of screws through the aligned screw holes, the clock mechanism, 30, projecting into the complementary wall hole, 50A. Since that portion of the back plate, 20A, which is exposed in the center opening of the time ring, 10, and the wall surrounding the time ring are similarly surfaced, and since the circumference of the back plate, 20A, is compatible with the outside circumference of the time ring, 10, the outer edge of the back plate is masked. There is the illusion that the clock was inserted in the wall before final construction of the wall. As an alternative to screw fastening, a self-retaining clock mechanism can be used with the full face ring sized back plate shown in FIGS. 1 and 2. In this case the back plate, 20A, is preferably attached to the time ring, 10, most easily by a glue, thus obviating, in this instance, the need for screw holes in both the time ring and back plate.

The alternate composition shown in FIG. 3, employing a smaller back plate, 20B, and a larger wall hole, 50B, allows both the said back plate and its surface covering to be recessed into the said wall hole, while the time ring, 10, is attached to the surface of the wall by means of screws through the screw holes, 11A, B, C and D. This permits the surfacing of the back plate with thicker material such as heavy wallpaper, paneled wallboard and even old wallpaper attached to the circular portion cut from the wall when making the hole. Because the outside circumference of the back plate, 20B is smaller than that of the time ring, 10, the outer edge of the back plate is concealed. Since the visible surfacing of the back plate and the wall are in the same plane, there is added credibility to the illusion of preconstruction insertion of the clock in the wall.

I claim:

1. An in-the-wall clock comprising, in combination:

(a) a housing containing a clock mechanism, said housing having a pair of clock handshafts protruding in a given direction from a front surface thereof, said front surface of said housing having a given maximum dimension, in a direction perpendicular to said given direction, (b) said housing being mounted in a wall with said front surface of said housing being substantially coplanar with said wall and said handshafts protruding out from the surface of said wall, (c) a plate having a handshaft hole in the center thereof, the smallest surface dimension of said plate being larger than said maximum dimension of said housing, (d) said plate mounted on said wall over said housing so as to conceal same, said handshafts protruding through said hole in said plate, the front surface of said plate finished similarly to said wall, (e) a decorative ring, optionally having clock numerals thereon, said ring having an inner diameter which is less than the smallest surface dimension of said plate, and an outer diameter which is equal to, or greater than, the largest surface dimension of said plate, (f) said ring being mounted onto said wall concentric to said handshafts so as to conceal the edge or edges of said plate, and (g) a pair of clock hands attached to said respective handshafts, whereby said plate will conceal said housing and said ring will conceal the edge or edges of said plate, so that said plate, when the surface is finished similarly to a wall, will appear to be a part of the surface of said wall, and it will appear that siad clock was preconstructed in said wall.

* * * * *